US007000513B2

(12) United States Patent
Zelinski, Jr. et al.

(10) Patent No.: US 7,000,513 B2
(45) Date of Patent: Feb. 21, 2006

(54) HIGH PRESSURE SEED POTATO CUTTER

(76) Inventors: William John Zelinski, Jr., P.O. Box 377, Plover, WI (US) 54437; Thomas Keith Tallackson, 771 Nebraska Ave. East, St. Paul, MN (US) 55106

( * ) Notice: Subject to any disclaimer, the term of this patent is extended or adjusted under 35 U.S.C. 154(b) by 0 days.

(21) Appl. No.: 09/935,335

(22) Filed: Aug. 21, 2001

(65) Prior Publication Data

US 2003/0037649 A1 Feb. 27, 2003

(51) Int. Cl.
*B26F 3/00* (2006.01)

(52) U.S. Cl. ..... 83/53; 83/177; 83/155; 83/156; 83/932

(58) Field of Classification Search ..... 83/932, 83/13, 53, 177, 409.1, 106, 167, 168, 155, 83/156; 47/89, 1.01 R, 58.1; 426/237
See application file for complete search history.

(56) References Cited

U.S. PATENT DOCUMENTS

| | | | | | |
|---|---|---|---|---|---|
| 1,758,587 | A | * | 5/1930 | Smith | 83/314 |
| 2,487,719 | A | * | 11/1949 | Meyer | 83/155 |
| 2,601,233 | A | * | 6/1952 | Spry | 83/169 |
| 3,090,414 | A | * | 5/1963 | Briggs | 83/105 |
| 3,096,801 | A | * | 7/1963 | Miles et al. | 83/404.2 |
| 3,570,050 | A | * | 3/1971 | Drapper et al. | 452/149 |
| 3,688,828 | A | | 9/1972 | Peterson | 146/164 |
| 4,787,178 | A | | 11/1988 | Morgan et al. | 51/418 |
| 4,876,934 | A | | 10/1989 | Fagan et al. | 83/879 |
| 4,913,044 | A | | 4/1990 | Heath | 99/494 |
| 5,031,496 | A | | 7/1991 | Lobash et al. | 83/107 |
| 5,269,211 | A | * | 12/1993 | Flaming | 83/39 |
| 5,331,874 | A | * | 7/1994 | Foster et al. | 83/423 |
| 5,528,967 | A | | 6/1996 | Maroney | 83/53 |
| 5,551,910 | A | * | 9/1996 | Nielsen et al. | 452/149 |
| 5,685,053 | A | | 11/1997 | Deonarine et al. | 29/426 |
| 5,934,186 | A | | 8/1999 | Alberga et al. | 99/489 |
| 6,125,729 | A | * | 10/2000 | Mirabello | 83/177 |
| 6,321,484 | B1 | * | 11/2001 | Zelinski et al. | 47/1.01 R |
| 6,375,565 | B1 | * | 4/2002 | Tanner et al. | 460/123 |

OTHER PUBLICATIONS

Journal of Food Science 57 (1), p. 132-137, 1992, ISSN: 0022-1147.*

* cited by examiner

*Primary Examiner*—Timothy V. Eley
*Assistant Examiner*—Phong Nguyen
(74) *Attorney, Agent, or Firm*—Curtis Harr

(57) ABSTRACT

A method of cutting seed potatoes prior to their planting is provided in which a high pressure water jet is employed to slice the potatoes into the desired sized pieces. The present invention employs a single water jet, a plurality of water jets, or a cutting tube configuration containing either single or multiple water jet streams which are projected through the center of the cutting tubes or the cutting area and an equal amount of stream collector tube or tubes which contain the jet or jets and collects and directs the spent water to a proper location for its final collection or final discharge. Additionally, the use of this water jet system ensures that the seed potatoes that are cut will not contaminate one another through the cutting instrument as the water used in the cutting process only comes into contact with one potato and is then discharged from the system.

10 Claims, 6 Drawing Sheets

FIG 4
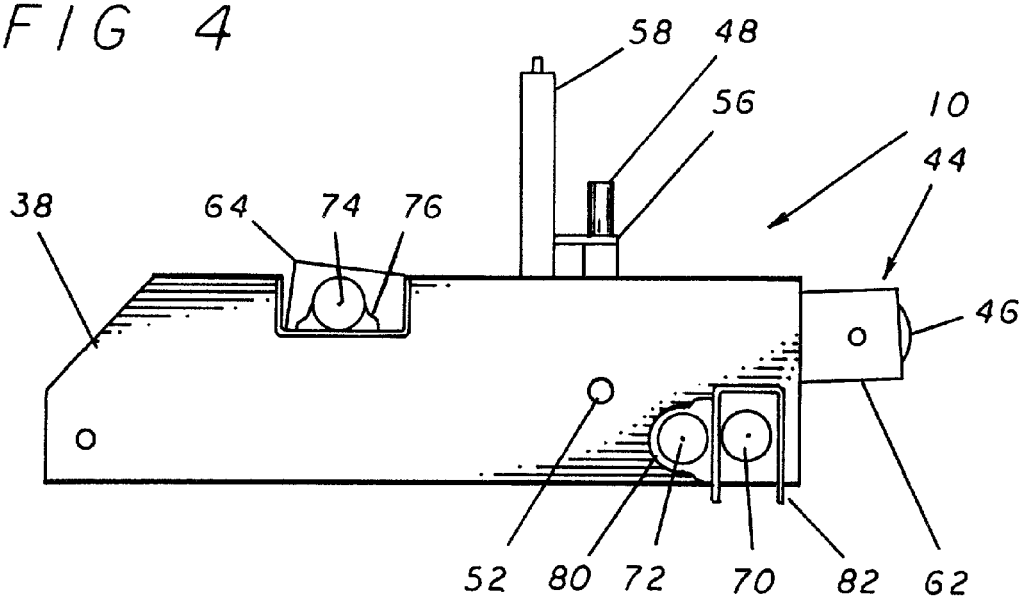
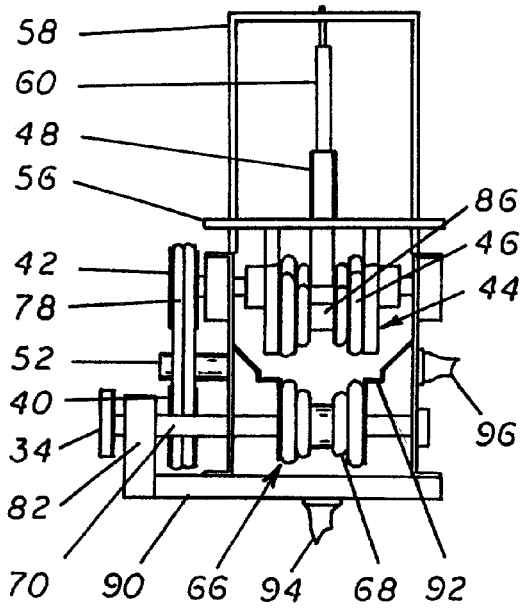
FIG 5
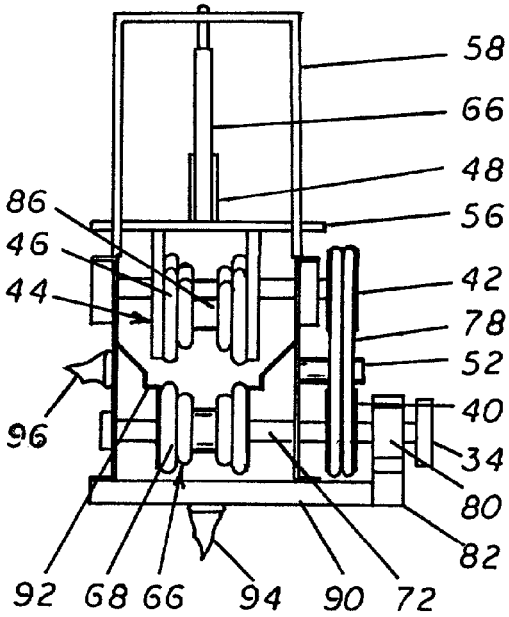
FIG 6

FIG 7
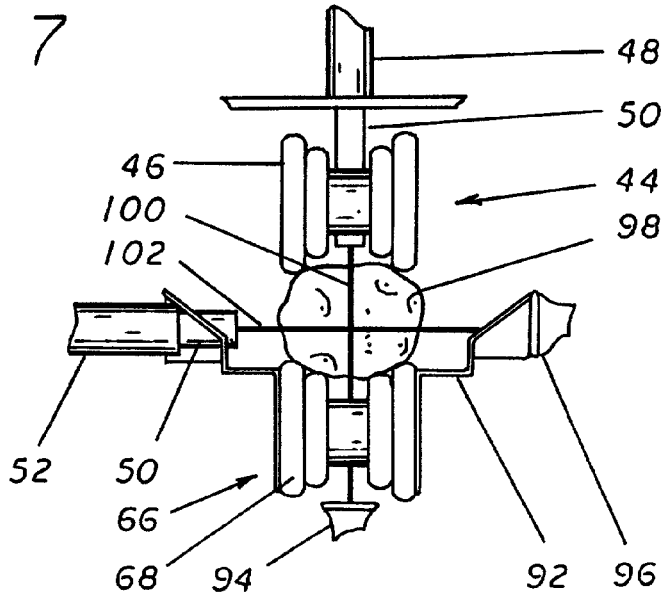
FIG 8
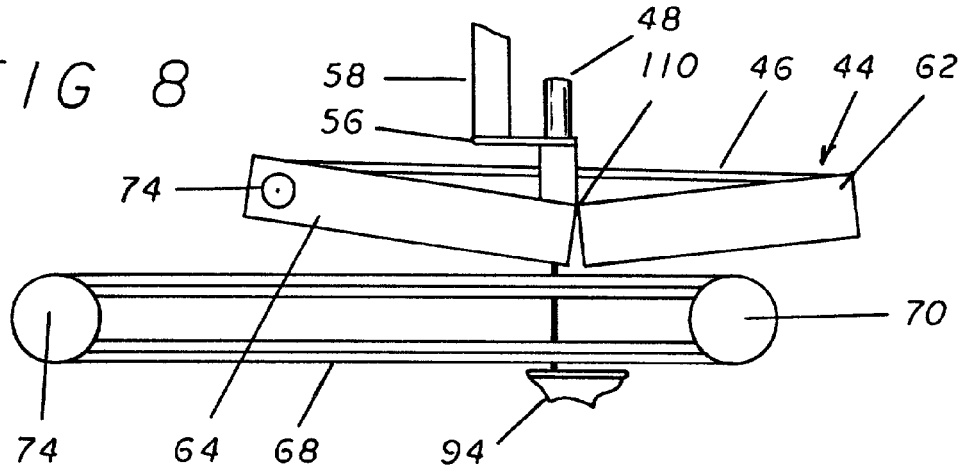
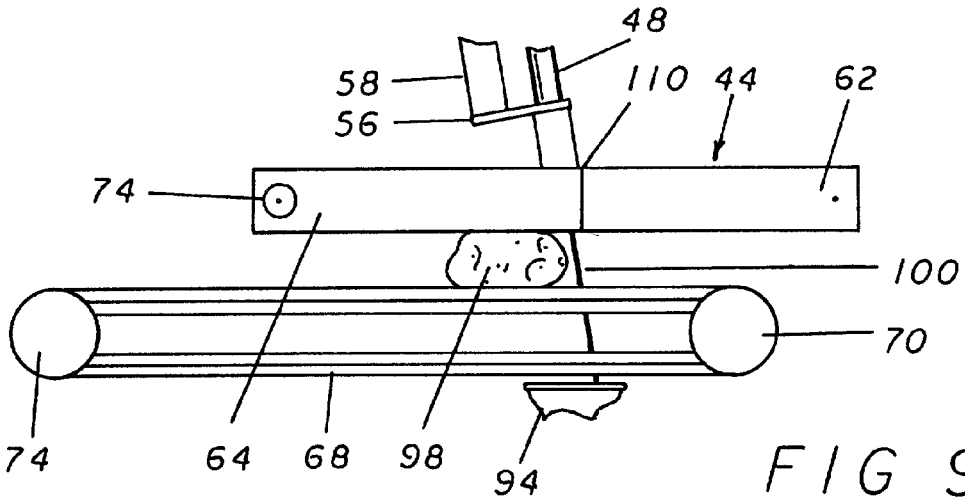
FIG 9

HIGH PRESSURE SEED POTATO CUTTER

CLAIM OF PRIORITY

The present application claims priority to U.S. application Ser. No. 09/642,876, filed on Aug. 21, 2000.

BACKGROUND OF THE INVENTION

The present invention relates to an improvement in the method used to cut and plant seed potatoes during spring planting. More specifically, to a method of cutting the seed potatoes prior to their planting in a manner that ensures that the cut potatoes will not be contaminated due to the possible presence of bacteria and other pathogens that are common to and create problems in potato crops.

It is well known to cut and size seed potatoes in a variety of ways prior to planting. In the past, seed potatoes have often been cut by hand with a common knife prior to planting. In the last twenty years large automatic seed cutters which use a blade to cut potatoes have gained in popularity. One of the issues with the use of a blade to cut seed potatoes has been the spread of disease from one potato to the next. When a blade cuts a potato that is diseased and is subsequently used again without cleaning, the disease may be spread to the next few potatoes that are cut. One solution to this has been the use of chemicals such as a bleach solution which may be used to clean the knife blade between cuttings. Although this practice can be effective if done properly this practice is both time consuming and can be unreliable if the blade is not cleaned thoroughly. Further, the use of a cleaning solution is not practical with most large seed cutting apparatuses and may only be effective when cutting seed by hand.

From this discussion it can be seen that it be desirable to find a method of cutting potatoes with a large commercial cutter and sorter that prevents the spread of disease from one piece of cut seed potato to the next.

SUMMARY OF THE INVENTION

It is the primary objective of the present invention to provide a method of cutting seed potatoes in such a manner that any bacteria or other pathogens that are present within a given seed potato will not be passed on to others by means of the cutting instrument.

It is an additional objective of the present invention to provide such a method of cutting seed potatoes that utilizes an extremely high pressure water jet cutting device for use with seed potatoes to ensure that the transfer of pathogens from one potato to another does not occur either during or after the cutting process.

It is a further objective of the present invention to provide such a method of cutting seed potatoes that utilizes a contained high pressure water jet that is commonly available in the market place today to perform the seed potato cutting operations.

It is a still further objective of the present invention to provide such a method of cutting seed potatoes that can be easily used with existing potato cutting and planting machines that are commonly used by potato farmers.

These objectives are accomplished by the use of a water jet cutter housing that can be fitted to the frame of a conventional potato sorting apparatus. This cutter housing contains a single or a plurality of water jet cutting mechanisms through which the seed potatoes are moved by means of a pair of forward moving conveyor apparatuses that are the core of the water jet cutter. The invention employs a separate singulator apparatus that aligns the potatoes prior to their entering the water jet cutter where they are cut by the water jets. After passing through the water jet cutting area, the cut seed potatoes move onto a separate conveying apparatus which carries them away from the invention for later use.

As previously stated, the cutting operations of the present invention are carried out by the use of an extremely high pressure water jet that is projected through the cutting area by a single or a plurality of jet bodies. The water jet stream has adjustable output pressure upwards of 60,000 pounds per square inch (psi), capable of cutting through virtually any material. Through testing, the potato cutting method appears to work most effectively at 40,000 psi. When the potatoes were cut with less psi, the pressure did not completely cut through the potato as effectively. In controlling abrasiveness at the desired psi, a size 4 orifice as is known in the art appeared to provide the most effective control of the resulting water stream. It has also been found that it is necessary to firmly hold the potato during the cutting process to ensure that the cuts are made effectively. The use of the conveyor apparatuses that grasp the potato's upper and lower surfaces is used. This results in an evenly cut potato which effectively produces the correctly sized and shaped potato pieces for proper planting. It is also possible to mix chemicals with the water to further prevent the spread of pathogens or to treat potatoes as desired.

Additionally, once the high pressure water jet has passed through the potato cutting area, it enters the open end of the stream collector tube which contains the jet and directs the spent water to a proper location for its final collection for reuse or to an appropriate location for discharge. The cutting area of the present invention is made up of the space between the upper and lower conveyor assemblies of the water jet potato cutter.

The individual water jet bodies can also be oriented in a variety of different configurations to obtain different types of cuts in the seed potatoes but, in its simplest configuration, a single jet of high pressure water is projected across the cutting area. This bisects the cutting area and as a seed potato passes through the water jet it is effectively cut in half before it exits the invention.

The use of a high pressure water jet cutting system to cut seed potatoes prior to planting not only provides an effective method to do so, but also eliminates one of the biggest problems associated with this process. When using a mechanical device to cut the seed potatoes prior to planting, any bacteria or other pathogens that are contained within an individual potato and that come into contact with the cutting instrument can be easily passed to additional potatoes that are subsequently cut. Thus, a significant percentage of the seed can be infected which can drastically reduce the ultimate yield of the crop. The use of the water jet cutting system eliminates this problem as each cut is done with water which has not come into contact with any other seed potatoes which ensures that any diseases or other pathogens contained in one seed potato cannot be passed to any others. Thus, this potential source of seed potato disease is eliminated by the present invention which means that the ultimate yield of the crop being planted will be increased dramatically which also increases the farmer's profits.

For a better understanding of the present invention reference should be made to the drawings and the description in which there are illustrated and described preferred embodiments of the present invention.

DESCRIPTION OF THE DRAWINGS

FIG. 4 is a side elevation view of the present invention having the drive belts and pulleys removed and illustrating the orientation of the primary axles and the general manner of construction of the gear reversal assembly which reverses the rotational power at the primary drive axle allowing the upper and lower conveyor belts to rotate in the same direction on their respective neighboring surfaces.

FIG. 5 is a front elevation view of the present invention illustrating the general orientation of the upper conveyor assembly in relation to the lower conveyor assembly and the channel that their respective conveyor belts form which channel the seed potatoes through the interior of the invention in the proper manner.

FIG. 6 is rear elevation view of the present invention illustrating the general orientation of the upper conveyor assembly in relation to the lower conveyor assembly and the channel that their respective conveyor belts form which draw the seed potatoes through the interior of the invention in the proper manner.

FIG. 7 is a front elevation detail view of the potato cutting area of the present invention detailing the manner in which the upper and lower conveyor assemblies grasp a seed potato in the cutting area to ensure its proper orientation during the cutting procedure resulting in portions of the correct shape and size for successful planting.

FIG. 8 is a side elevation view of the upper and lower conveyor assemblies of the present invention illustrating their orientation in relation to one another when there is no potato in the cutting area.

FIG. 9 is a side elevation view of the upper and lower conveyor assemblies of the present invention illustrating their orientation in relation to one another when there is a potato in the cutting area.

DESCRIPTION OF THE PREFERRED EMBODIMENT

Figure 1:
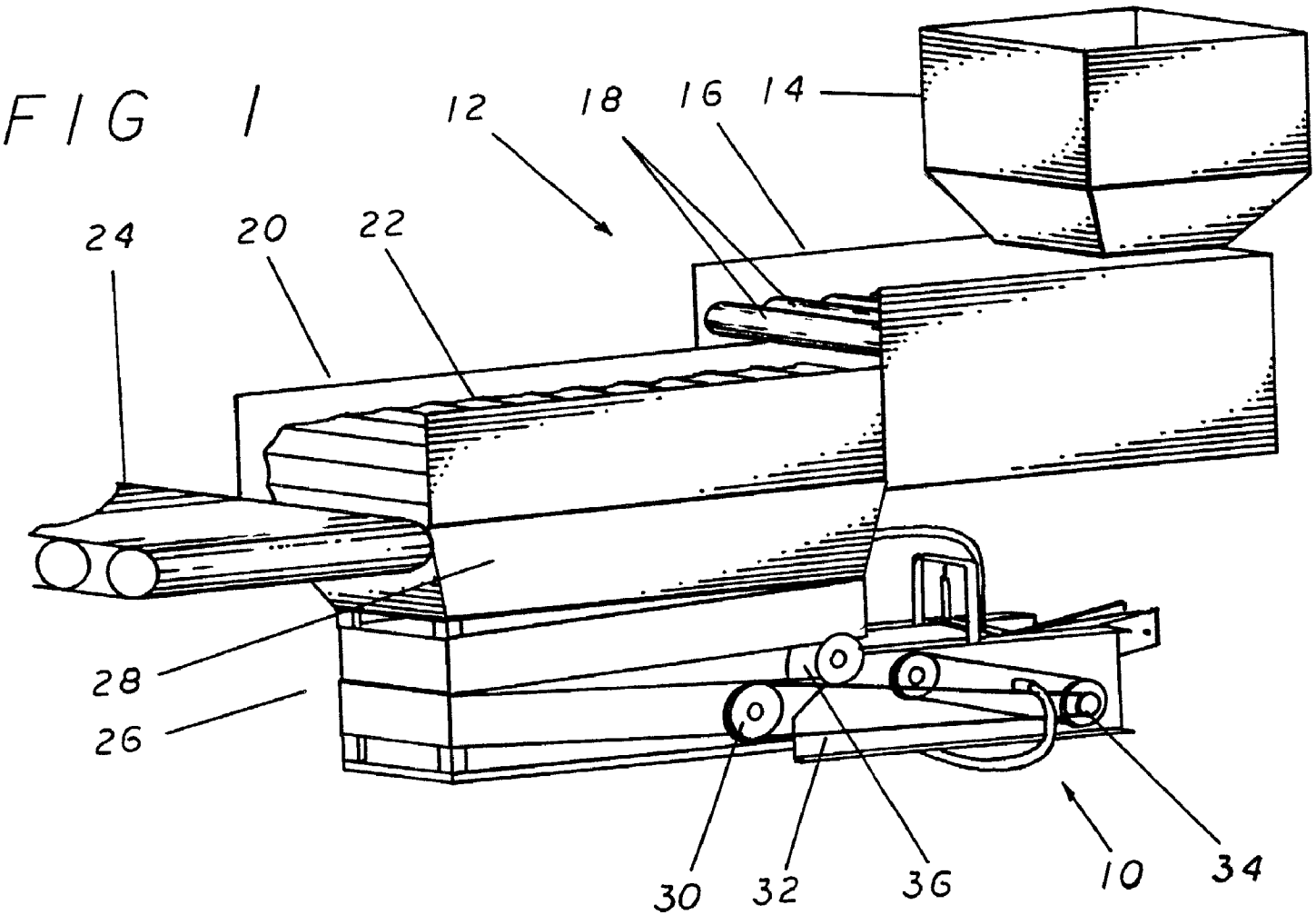
FIG. 1 is a perspective view of a the present invention as used in conjunction with a seed potato sorting machine which provides the invention with the proper sized seed potatoes enabling it to cut them using a water jet cutting process into appropriate sizes for planting.

Referring now to the drawings, and more specifically to FIG. 1, the water jet seed potato cutter 10 is used in conjunction with a typical seed potato sorter 12 which is illustrated in a very general manner. The seed potato sorter 12 is available in a wide variety of configurations which are all capable of sorting potatoes of specific sizes for a variety of uses. In this example, an unsorted group of seed potatoes is initially transferred from a potato reservoir 14 to a star wheel tray 16. The star wheel tray 16 is a sorting device made up of a series of rotationally driven star wheel rollers 18 that are employed in this case to remove the smallest of the seed potatoes that do not require any cutting prior to their being planted by the machine.

The remaining potatoes pass from the star wheel tray 16 to the primary sorting tray 20 which is generally a box-like apparatus containing the sizing grate 22. The sizing grate 22 is a specially designed apparatus that is configured as to allow potatoes of a specific size to fall through to continue on the path towards the present invention. Thus, for example, the sorting table 20 can be set up to allow 2 ounce seed potatoes to pass through and continue towards the present invention that is also configured to handle and cut seed potatoes of that specific weight. Any potatoes that do not fall through the sizing grate 22 pass from the sorting tray 20 to the conveyor 24 which removes them to a place of storage for alternatives uses or later disposal. It is important to note that the seed potatoes are pre-sorted to a certain degree so that this potential source of added complexity or waste is kept to a minimum during the operation of the present invention.

After falling through the sizing grate 22, potatoes of the proper size are collected by the singulator hopper 28 which channels them into the interior of the singulator 26. The singulator 26 is an important component for the correct operation of the present invention as its primary function is to align the sorted potatoes into a single file row prior to their entering the invention for the cutting operation. The seed potatoes pass through the singulator 26 until they come into contact with the sorter wheel 36 located at the rear of the singulator 26. The sorter wheel 36 grasps the individual potatoes from the single file line and channels them one at a time into the rear of the interior cavity of the present invention.

Additionally, this FIGURE illustrates the manner in which rotational power is supplied to the present invention from an auxiliary drive pulley 30 located on the body of the singulator 26 through the primary drive belt 32 to the primary drive pulley 34 on the exterior surface of the present invention. The rotational power supplied in this manner is employed by the invention to power its internal conveyors which drive the seed potatoes into the proper location for their cutting in the high pressure water stream while holding them securely. This manner of positioning and grasping the potatoes ensures that they are properly cut.

Figure 2:
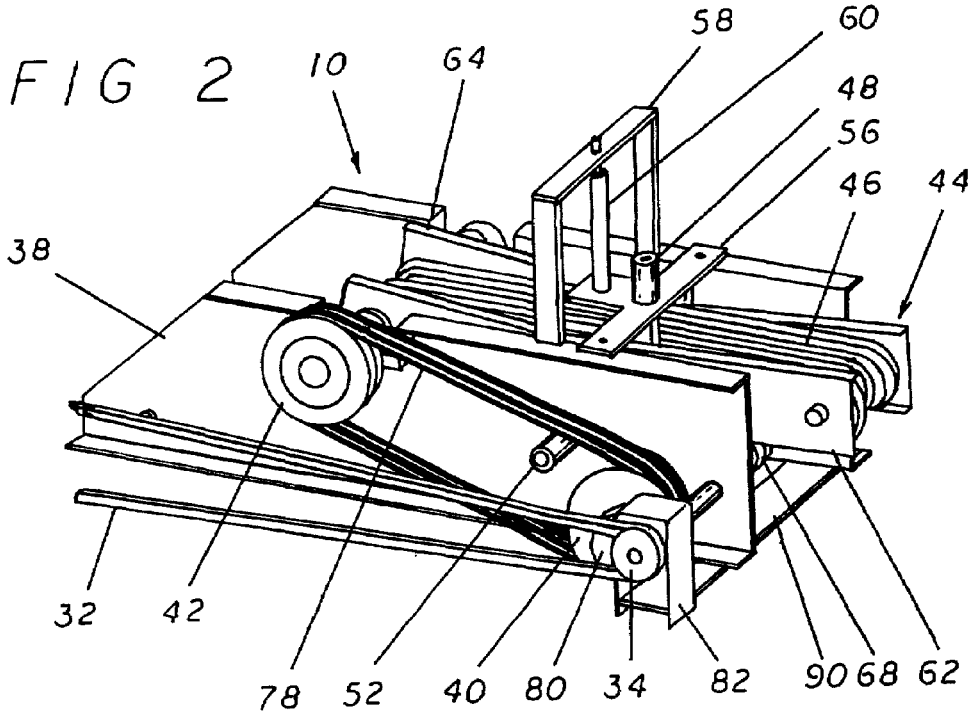
FIG. 2 is a perspective view of the present invention illustrating its general manner of construction and the ways in which rotational power is supplied to the upper and lower conveyor assemblies by an auxiliary pulley on the singulator component of a sorting machine.
Figure 3:
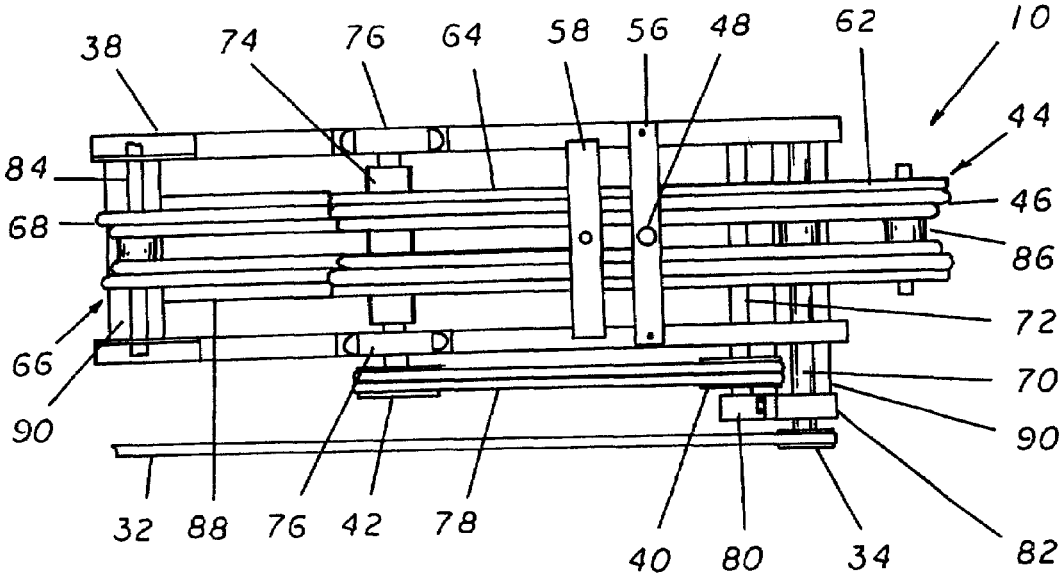
FIG. 3 is a top elevation view of the present invention illustrating its general manner of construction and the orientation of the upper and lower conveyor belt assemblies in relation to the other major components and the invention's drive components.

The manner in which the rotational power is transferred from its source to the present invention is further illustrated in FIGS. 2 and 3 which detail the general location of the primary drive pulley 34 and the primary drive belt 32 feeding it. The primary drive pulley 34 is located on the outside end of the primary drive pulley axle 70 at the forward end of the body of the invention. Behind the primary drive pulley 34, the primary drive pulley axle 70 passes through the gear housing bracket 82 which, on its rearward surface relative to the overall orientation of the invention, serves as the mounting point for the reverse gear housing 80. The reverse gear housing 80 is connected through internal gearing to the primary drive pulley axle 70 and operates to reverse the rotational force at this point of its transfer.

The reversed rotational force is then used to drive the lower conveyor transfer pulley 40 which is in turn connected at the outer end of the lower conveyor transfer axle assembly 72. The lower conveyor transfer pulley 40 is then in turn connected through the transfer drive belts 78 to the upper conveyor drive pulley 42. With this design, the system operates to transfer the rotational power supplied at the primary drive pulley 34 to both the lower conveyor assembly 66 and the upper conveyor assembly 44 in a manner that will allow the contained upper and lower conveyor belts, 46 and 68, to rotate in the proper direction to channel seed potatoes through the interior of the present invention.

The general manner of construction of the body of the present invention is further illustrated in FIGS. 2, 3, and 4, which detail the manner in which the longitudinally oriented cutter frames 38 and the laterally oriented cutter frame cross-members 90 are joined to form the platform upon which the remaining components of the present invention are built. The positioning of the cutter frames 38 forms a rectangularly shaped box having an open interior which provides for the placement of the upper and lower conveyor assemblies, 44 and 66. The open ended nature of this design allows the seed potatoes to be fed into the rear of the invention prior to their being cut and ejected at the front.

These FIGURES also further detail the location and orientation of the reversing gear housing 80 and gear housing bracket 82 and their respective positions relative to the primary drive pulley axle 70 and the lower conveyor transfer pulley axle assembly 72. Additionally, they also illustrate the manner in which the upper conveyor drive pulley axle assembly 74 spans the distance between the two cutter frames 38 at the upper rear surface and the use of the upper conveyor drive pulley axle mount 76 to rotationally attach it in that position. Finally, theses FIGURES also depict the positioning of the spring frame 58 and jet bracket in relation to the remaining components of the present invention.

FIGS. 3, 5, and 6 illustrate the general configuration of the upper and lower conveyor assemblies, 44 and 66, and the manner in which they are attached to and interact with the other components. The lower conveyor assembly 66 spans the length of the cutter frame from the primary drive pulley axle 70 at the forward end of the invention and the lower conveyor idler axle 84 at the rear of the invention. The interior length of the lower conveyor assembly 66 defined by the outer limits of the primary drive pulley axle 70 and the lower conveyor idler axle 84 is encircled by the plurality of lower conveyor belts 68 which form a moveable floor within the invention's body. The outside length of the lower conveyor assembly 66 is also enclosed by the lower conveyor frame 88 which adds overall structural support to the lower conveyor belts 68. Additionally, it is important to note that these lower conveyor belts 68 differ in their circumference so that the interior ones are smaller than those on the outside. This results in a V-shaped configuration in the cross-sectional aspect of the lower conveyor belt's configuration that its ability to hold a potato securely as it passes it through the interior of the invention.

The upper conveyor assembly 44 is made up of an upper forward frame 62 and an upper rearward frame 64 which, in conjunction with the upper conveyor drive pulley axle assembly 74 and the upper conveyor idler axle 86, define its overall length. The upper conveyor assembly 44 extends from a point in the cutter frame 38 located approximately one third of the its length in relation to its rear extremity to a point that is well beyond the most forward end of the cutter frames 38. This design results in the most rearward portion of the lower conveyor assembly 66 being uncovered in respect to the positioning of the upper conveyor assembly 44. The relative positioning between the upper and lower conveyor assemblies, 44 and 66, allows for the insertion the seed potatoes into the interior of the present invention for the cutting operation. Additionally, the positioning of the upper conveyor assembly 44 which results in its forward portion overhanging the most forward extent of the lower conveyor assembly 66, ensures that the cut potato falls correctly once it clears the forward end of the invention.

The length of the upper conveyor assembly 44 is encircled by the use of the plurality of upper conveyor belts 46 which, in much the same manner as the lower conveyor belts 68, differ in their overall circumference so that the interior ones are shorter than those on the outside. This again results in a V-shaped configuration that works to provide a more stable positioning of a potato as it passes through the interior of the invention. The V-shaped nature of the upper and lower conveyor belts, 46 and 68, is further detailed in FIG. 7 which illustrates the positioning of a seed potato 98 between the upper and lower conveyor belts, 46 and 68. Here it is clearly shown how the configuration of the upper and lower conveyor belts, 46 and 68, work to firmly grasp the potato 98 which is critical to the operation of the present invention as the strength of the vertical and horizontal water streams, 100 and 102, is enough to deflect the potato 98. If the potato was allowed to be deflected in this manner, it would result in an improperly cut potato 98 that would be unfit for planting purposes.

FIG. 7 also illustrates the manner in which the shape of the lower conveyor floor 92 is designed to enhance the V-shaped nature of the lower conveyor belts 68 to ensure the proper orientation of a potato as it passes through the invention. The overall centered and downwardly stepped design of the lower conveyor floor 92 tends to move anything contacting it, most notably potatoes, towards the center and the V-shape of the lower conveyor belts 68 which will move it through the body of the invention.

The lower conveyor floor 92 also operates in the positioning of the vertical and horizontal water jets, 50 and 54, in relation to the upper and lower conveyor belts, 46 and 68, and the subsequent positioning of the seed potato 98. Also illustrated are the positioning of the vertical and horizontal water jet housings, 48 and 52, which secure their respective jets to the external components of the invention. Additionally, the positioning of the vertical and horizontal discharge tubes, 94 and 96, are depicted. The vertical and horizontal discharge tubes, 94 and 96, are the components of the invention that are used to collect and dissipate the vertical and horizontal water streams, 100 and 102, after they have passed through the potato 98 cutting area.

An additional feature of the upper conveyor assembly 44 is illustrated in FIGS. 8 and 9 which detail its articulating manner. This articulation is a result of its manner of construction using the upper forward and rearward frames, 62 and 64, which are pivotally joined at their inner shared surface by the upper conveyor assembly hinge point 110. This manner of construction allows the upper conveyor assembly 44 to articulate in its relative center thus, adapting to the presence of a potato 98 as it passes through the invention while maintaining a firm grasp on it at all times.

These FIGURES also illustrate a feature of the vertical discharge tube 94 that is a direct result of the articulating nature of the upper conveyor assembly 44. The vertical discharge tube 94 is elongated in reference to the length of the invention's body so that it can capture the vertical water stream 100 regardless of the orientation of the upper conveyor assembly 44. This is important as the vertical water jet housing is fixedly attached to the upper conveyor assembly 44 through the jet bracket 56. Thus, as the upper conveyor assembly 44 articulates during the passage of a potato 98, the terminus of the vertical water stream 100 changes relative to the vertical discharge tube 94. Therefore, the upwardly facing opening in the vertical discharge tube 94 is elongated to compensate for this varying vertical water stream 100 terminus. Additionally, it should be noted that in the construction of the present invention the vertical water stream 100 must be placed in front of the horizontal water stream 102 because this motion as a result of the articulation of the upper conveyor assembly 44 would cause the streams to interrupt one another if they were otherwise constructed.

Figure 10:
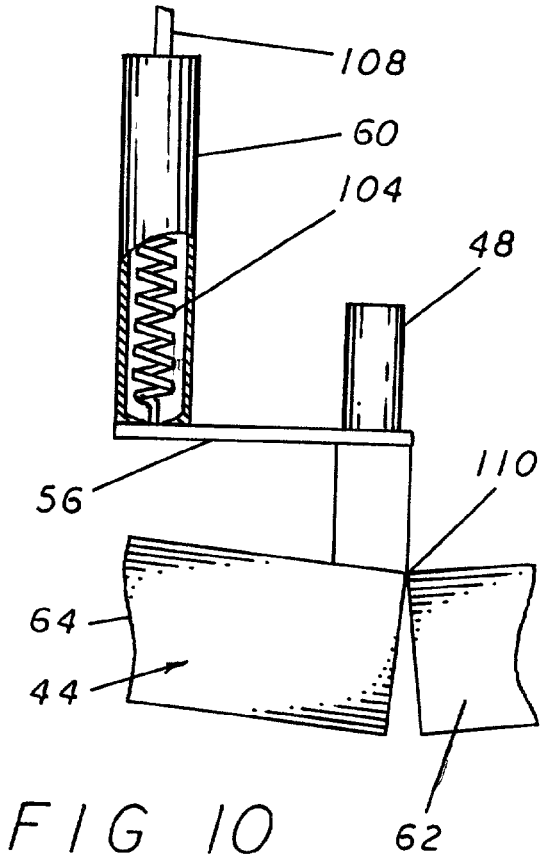
FIG. 10 is a side elevation cut-away view of the hinge joint portion of the upper conveyor assembly of the present invention illustrating the orientation of the tension spring when the upper conveyor assembly is in an articulated position due to the lack of a potato in the cutting area.
Figure 11:
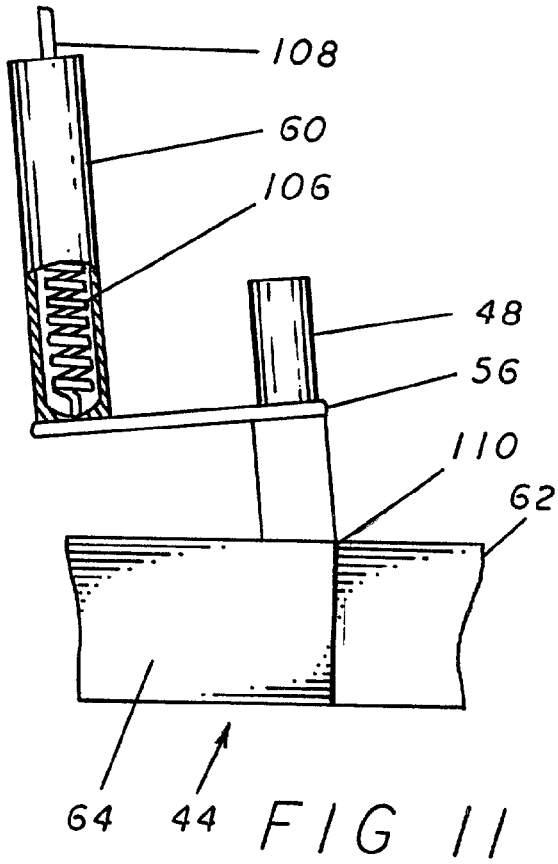
FIG. 11 is a side elevation cut-away view of the hinge joint portion of the upper conveyor assembly of the present invention illustrating the orientation of the tension spring when the upper conveyor assembly is in a raised position due to the presence of a potato in the cutting area.

Finally, the manner of construction of the spring housing 60 component of the present invention is further detailed in FIGS. 10 and 11. The spring housing 60 operates to enhance the articulating action of the upper conveyor assembly 44 and, more specifically, to enable the upper conveyor assembly 44 to articulate in an upward manner to allow for the easier passage of a potato 98 through the interior of the invention. This is a result of a slightly upward pressure being placed on the upper conveyor assembly 44 by the loaded tension spring 104 located within the spring housing 60. The loaded tension spring 104 is connected at its bottom end to the upper conveyor assembly 44 through the jet bracket 56 and at its upper end to the remaining components of the present invention through the spring connecting rod 108 and the spring frame 58.

The upward pressure that results from this manner of construction allows the upper conveyor assembly 44 to more easily accommodate the presence of a potato 98 without losing the grasping ability of the upper and lower conveyor belts, 46 and 68. Thus, as a potato passes through the invention and the upper conveyor assembly 44 articulates upward resulting in an unloaded tension spring 106. Once the potato clears the interior of the invention, the upper conveyor assembly 44 returns to its normal orientation resulting again in a loaded tension spring 104 placing upward pressure on the articulating upper conveyor assembly 44.

Figure 12:
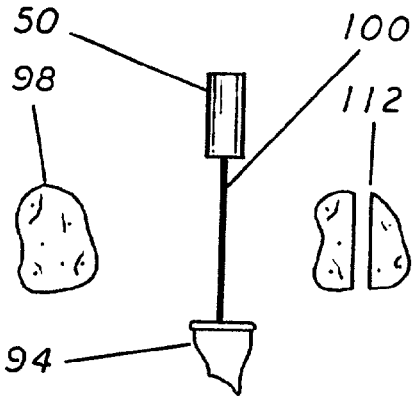
FIG. 12 is a front elevation view of a potato passing through the vertical cutting water stream of the present invention to produce a single cut seed potato for planting purposes.
Figure 13:
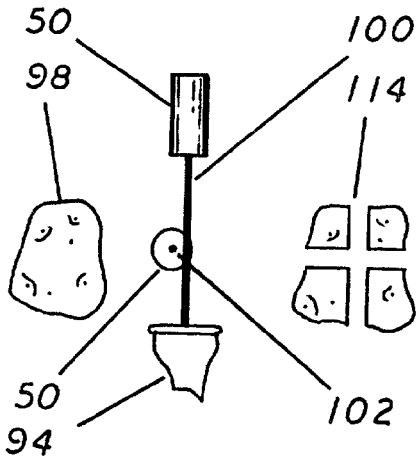
FIG. 13 is a front elevation view of a potato passing through the vertical and horizontal cutting water streams of the present invention to produce a double cut seed potato for planting purposes.
Figure 14:
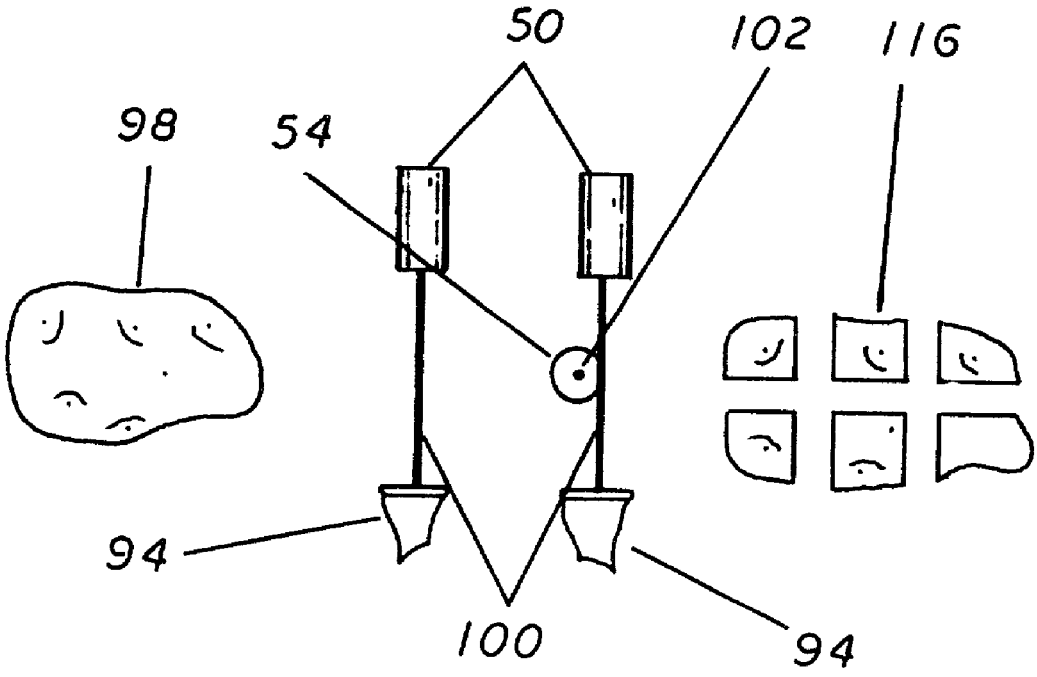
FIG. 14 is a front elevation view of a potato passing through the vertical and horizontal cutting water streams of the present invention to produce a triple cut seed potato for planting purposes.

The basic manner in which a potato 98 is cut using the present invention is illustrated in FIGS. 12, 13, and 14 which detail a plurality of the possible configurations for the orientation of the vertical and horizontal water jets, 50 and 54 and their corresponding vertical and horizontal discharge tubes, 94 and 96. FIG. 12 illustrates a configuration which employs a single vertical water jet 50 resulting in only the vertical water stream 100 coming into contact with the passing potato 98. The potato 98 comes into contact with the vertical water stream 100, which is generated by an externally located high pressure pump, as it passes through the present invention and which slices it cleanly in two resulting in the single cut potato 112. The single cut potato 112 is thus cut into the appropriate size as to maximize its growth potential when planted.

An alternative configuration of the cutting apparatus employed by the present invention is illustrated in FIG. 13 which adds a horizontal water jet 54 directing a horizontal water stream 102 through the interior of the invention just behind the central portion of the vertical water stream 100. This configuration produces a cutting area that is bisected in both the vertical and horizontal planes resulting in a double cut potato 114 that is sectioned into four separate pieces. This configuration is generally employed with potatoes 98 that are larger and heavier than those in the previous configuration but still leaves pieces of a large enough size so as to have the requisite plant producing eyes that are necessary for successful planting.

Finally, a third possible configuration of the cutting apparatus employed by the present invention is illustrated in FIG. 14 which details the use of a pair of vertical water jets 50 and a horizontal water jet 54. This configuration produces a pair of bisecting vertical and a single horizontal water stream, 100 and 102, which operate to cut a potato 98 into a triple cut potato 116 having six relatively equal pieces. The use of multiple vertical and horizontal water jets, 50 and 54, is employed with still larger potatoes 98 than the previous configuration and, as with all configurations of the cutting area, the potato 98 sizing is a function of using the proper sorting table that was previously described in conjunction with each of the possible vertical and horizontal water jet, 50 and 54, configurations. Again, the potato pieces produced in this manner are of sufficient size to contain the eyes that result in new plant growth.

This method of potato 98 cutting prior to planting is more effective than previous methods employing the use of metallic cutting implements as any diseases or pathogens present in one potato 98 will not be transferred to the others via the cutting blades. The result of this is a more productive potato growing operation as a common source of disease, the transfer of existing pathogens, has been eliminated.

Although the present invention has been described in considerable detail with reference to certain preferred versions hereof, other versions are possible. Therefore, the spirit and scope of the appended claims should not be limited to the description of the preferred versions contained herein.

What is claimed is:

1. A method for preventing the spread of disease through a knife when cutting seed potatoes by eliminating said knife and for cutting seed potatoes for planting with a liquid comprising the steps of:

supplying seed potatoes for planting;

sizing said seed potatoes by separating seed potatoes for cutting into seed;

moving said seed potatoes to a lower conveyor having a first end and a second end said conveyor having a V shaped belt for grasping the lower portion of said seed potato;

conveying said seed potatoes on said lower conveyor starting at said first end of said lower conveyor to contact with an upper conveyor having a first end and a second end, said first end of said upper conveyor being forward of said first end of said lower conveyor and said second end being forward of said second end of said lower conveyor, said upper conveyor having a V shaped belt for grasping the upper portion of said seed potato;

supplying a chamber between said upper and lower conveyor with a water jet passing across said chamber;

grasping said seed potatoes between said upper and lower conveyor and moving said seed potatoes for cutting through said water jet; and cutting said seed potatoes completely through with said water jet.

2. The method of claim 1 wherein the spent water from said water jet cut is collected by a discharge tube.

3. The method of claim 2 wherein the water used by said water jet contains a chemical additive.

4. The method of claim 3 wherein at least two water jets are used to make multiple cuts on said seed potatoes.

5. A method for cutting seed potatoes and of preventing the spread of disease caused by a cutting knife by eliminating the use of said knife comprising the steps of:

supplying seed potatoes for planting;

sizing said seed potatoes by separating seed potatoes for cutting into seed using a sorter;

moving said seed potatoes to a lower conveyor having a first end and a second end said conveyor having a V shaped belt for grasping the lower portion of said seed potato;

conveying said seed potatoes on said lower conveyor starting at said first end of said lower conveyor to contact with an upper conveyor having a first end and a second end, said first end of said upper conveyor being forward of said first end of said lower conveyor and said second end being forward of said second end of said lower conveyor, said upper conveyor having a V shaped belt for grasping the upper portion of said seed potato;

supplying said upper conveyor with hinge point between said first and second end of said upper conveyor such that said upper conveyor may articulate;

holding said seed potatoes in a stable position between said upper and said lower conveyor;

moving said seed potatoes for cutting through at least one high pressure water jet, by turning said lower and upper conveyors; and cutting said seed potatoes completely through with said high pressure water jet.

6. The method of claim 5 wherein a liquid source is supplied to said high pressure water jet.

7. The method of claim 6 wherein the spent liquid from the high pressure water jet cut is directed away from said high pressure water jet by a discharge tube.

8. The method of claim 7 wherein the termination point of said water jet is supplied by said discharge tube.

9. The method of claim 6 wherein said liquid source contains water and a chemical additive.

10. The method of claim 5 wherein at least two water jets are used to make multiple cuts on said seed potatoes.

* * * * *